US005297803A

United States Patent [19]

Solheim

[11] Patent Number: 5,297,803

[45] Date of Patent: * Mar. 29, 1994

[54] WEIGHTED CAVITY BACK GOLF CLUB SET

[75] Inventor: Karsten Solheim, Phoenix, Ariz.

[73] Assignee: Karsten Manufacturing Corporation, Phoenix, Ariz.

[ * ] Notice: The portion of the term of this patent subsequent to Mar. 16, 2010 has been disclaimed.

[21] Appl. No.: 7,195

[22] Filed: Jan. 21, 1993

Related U.S. Application Data

[63] Continuation-in-part of Ser. No. 749,553, Aug. 23, 1991, Pat. No. 5,193,805.

[51] Int. Cl.[5] ..... A63B 53/00

[52] U.S. Cl. ..... 273/77 A; 273/169; 273/167 A; 273/167 F

[58] Field of Search ..... 273/77 R, 77 A, 167 R, 273/167 A, 167 D, 167 F, 167 J, 167 K, 169, 171, 173, 174

[56] References Cited

U.S. PATENT DOCUMENTS

| | | | |
|---|---|---|---|
| D. 232,371 | 8/1974 | Becker | 273/167 F |
| D. 247,383 | 2/1978 | Adkins | D34/5 |
| 1,139,985 | 5/1915 | Legh . | |
| 4,621,813 | 11/1986 | Solheim | 273/77 A |
| 4,883,275 | 11/1989 | Boone | 273/172 |

*Primary Examiner*—Vincent Millin
*Assistant Examiner*—William M. Pierce
*Attorney, Agent, or Firm*—Haynes, Jr. Herbert E.; Darrell F. Marquette

[57] ABSTRACT

A correlated set of golf clubs the heads of which each have a top ridge that extends longitudinally along the upper part of the head between the heel and toe ends thereof with enlarged mass concentrations being formed to provide upper protuberances at the heel and toe ends of the ridge. The top ridge and the upper heel and toe protuberances are especially configured to locate mass concentrations high on the heads and set back from the striking faces thereof to provide the club heads with an improved ability to resist twisting of the club heads upon laterally off-center impacts with a golf ball and to resist tilting of the club heads upon vertically off-center impacts with a golf ball.

25 Claims, 5 Drawing Sheets

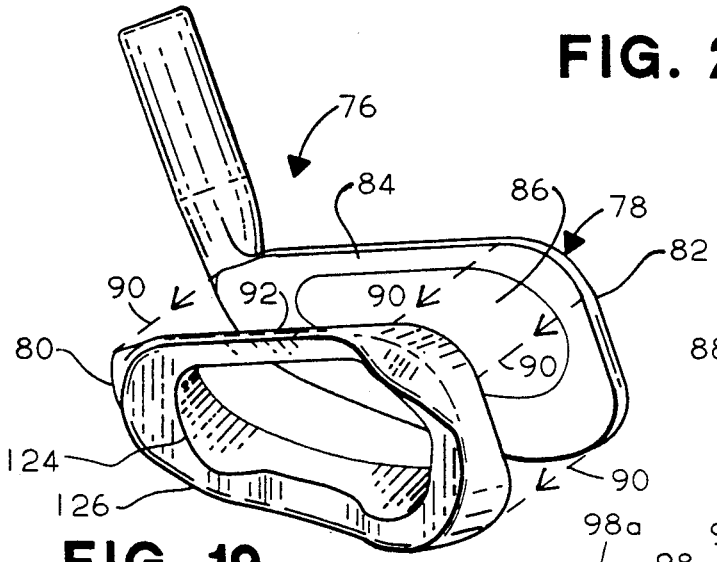
FIG. 21
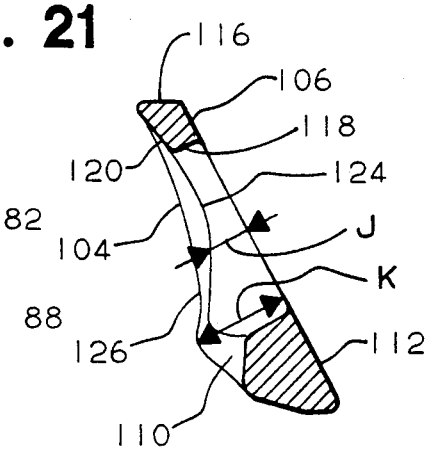
FIG. 19
FIG. 22
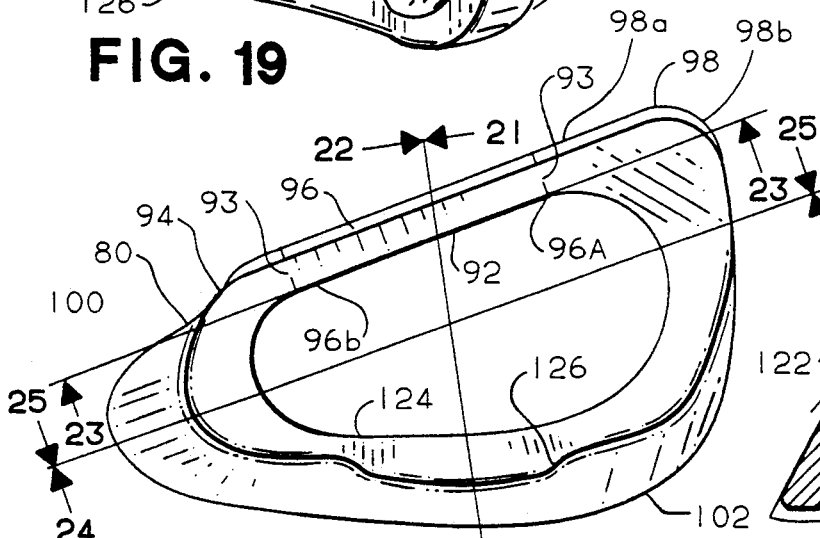
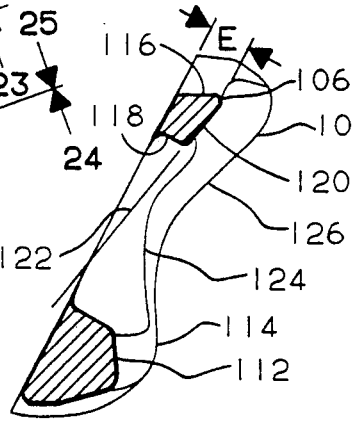
FIG. 20
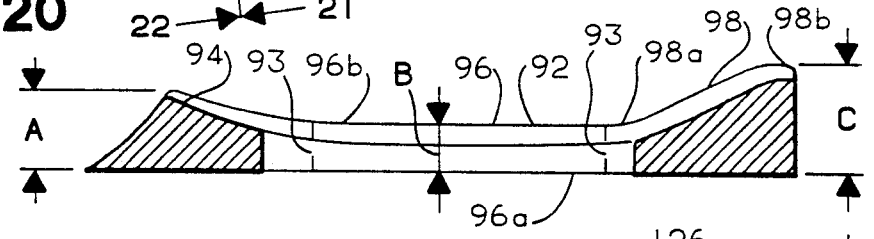
FIG. 23
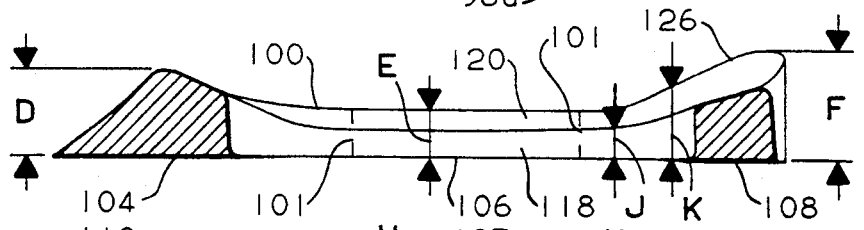
FIG. 24
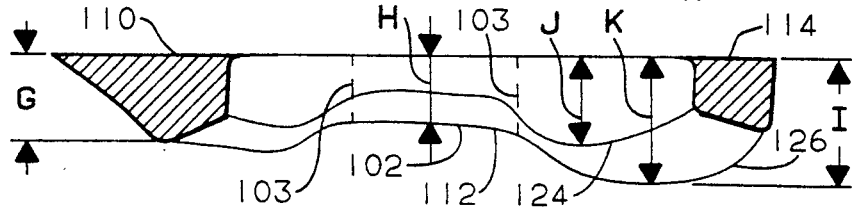
FIG. 25

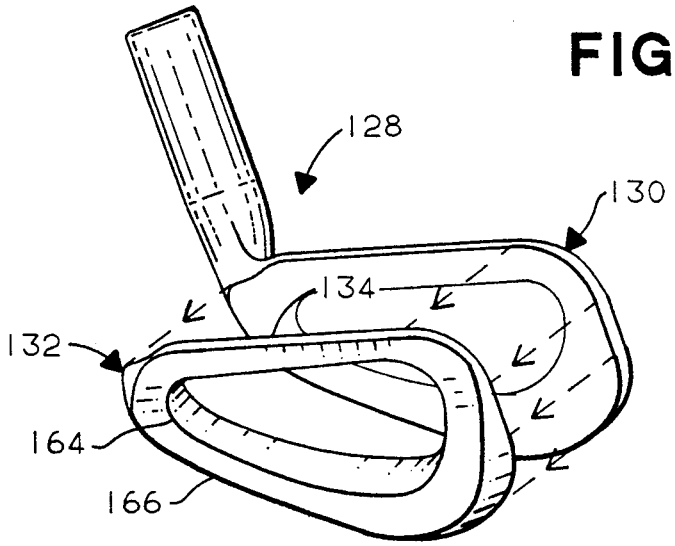
FIG. 26
(PRIOR ART)
FIG. 28
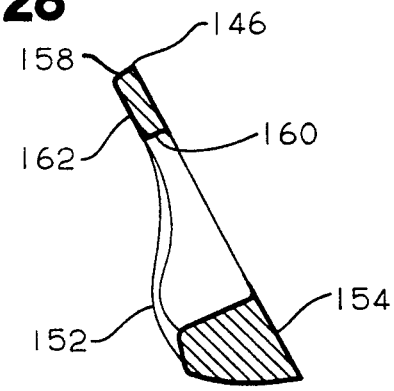
FIG. 29
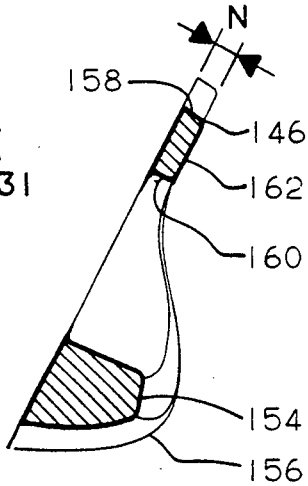
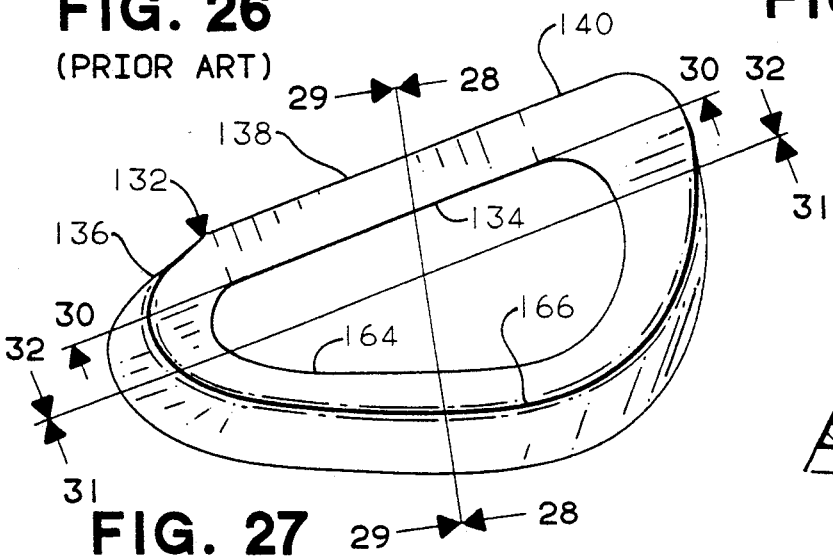
FIG. 27
FIG. 30
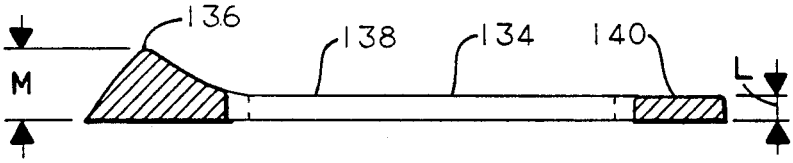
FIG. 31
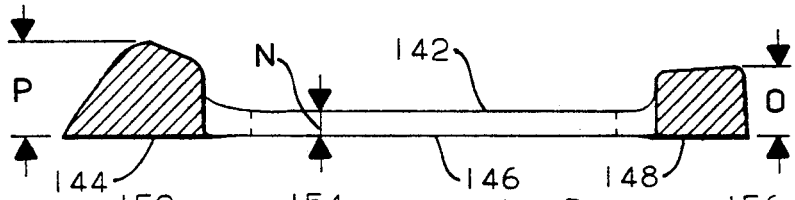
FIG. 32
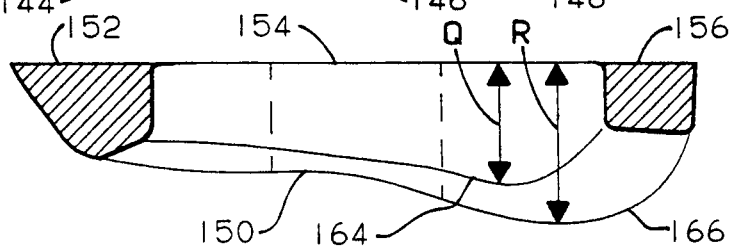

WEIGHTED CAVITY BACK GOLF CLUB SET

This is a continuation-in-part of application Ser. No. 07/749,553 filed Aug. 23, 1991, now U.S. Pat. No. 5,193,805.

BACKGROUND OF THE INVENTION

1. Field of the Invention

This invention relates in general to golf clubs and more particularly to the type of golf clubs known as irons with these iron golf clubs having improved performance characteristics resulting from strategic changes in weight distribution.

2. Description of the Prior Art

Although a golfer controls the swinging of a golf club, at the moment of impact the club head acts as though it were a free mass moving at a particular velocity. Most of the energy of this moving mass is transferred to the golf ball in about half of a millisecond with the result being that the ball, which is compressed against the face of the club, will spring clear as it returns to its spherical configuration. Maximum energy transfer and desirable golf ball flight direction and trajectory are achieved when the golf club head impacts a golf ball on the "sweet spot" of the club. The sweet spot of a golf club head is a point on the face of the club head which is in general alignment with the center of gravity of the golf club.

It is very difficult even for highly skilled and experienced golfers to consistently impact a golf ball on the sweet spot of a golf club, and when the sweet spot is missed the golf club will tend to twist, i.e., the face of the club will move from a position of being square with the intended flight path of the ball. When this happens, the amount of energy transferred to the golf ball will be less than maximum which results in a loss of distance. Also such twisting, or turning, of the golf club face will cause the golf ball to deviate from an ideal flight path.

To minimize the effects of mis-hitting a golf ball, modern golf club design has produced a class of game improvement golf clubs which are sometimes referred to as cavity back, or perimeter weighted clubs. As the name suggests, such clubs are formed with a central hollow, or cavity, in the back surface thereof, and the metal which would otherwise be located in the cavity is redistributed in predetermined proportions to strategic locations on the club heads. A relatively large mass is concentrated in the sole of these game improvement clubs to lower the center of gravity. This makes it easier for a golfer to get the center of gravity of the club head below the center of gravity of a golf ball at the moment of impact for producing a properly airborne and solidly hit ball. In addition, relatively large concentrations of mass are located in the heel and toe areas of the cavity back club to minimize the effects of hitting a golf ball on the toe or heel of the club head. When toe or heel hits occur, the club head will twist about the center of gravity. Such twisting, as mentioned above, results in less than a maximum transfer of energy to the golf ball at impact and deviations from the intended flight path of the ball will occur. By designing the golf club head with relatively large concentrations of mass in the toe and heel areas of the club head, the moment of inertia is increased so that the golf club will resist twisting movements in response to laterally off-center hits, i.e., in the directions of the toe and heel of the club head.

Many prior art golf clubs have been designed with mass concentrations in the sole, toe and heel areas of the club head in attempts to achieve optimum weight distribution benefits. The degree of success in achieving these design objectives varies from one club head to another in that the club's performance relies, along with other design parameters, on the proportions of the mass concentrations and the locations of those concentrations.

In a prior art design of mine, which is fully disclosed in U.S. Pat. No. 4,621,813, I removed metal from the central area at the back edge of the sole of the golf club head where it forms a junction with the lower edge of the back surface thereof. The removed metal was relocated to strategic areas in the toe and heel portions of the club head. This redistribution of material resulted in improved resistance to twisting as a result of lateral mis-hitting of the club, i.e., in the direction of the hoe or heel of the club and this improvement was made without any change in the total weight of the club head. Further, this improvement was made without sacrificing any other desirable characteristics of the golf club in that the relocated material was taken from a non-crucial area of the golf club head.

In most modern golf club designs, including mine as set forth in the hereinbefore disclosed U.S. Patent, considerably more than half of the golf club head mass is located in the lower part of the golf club head. As described above, the reason for this is to take advantage of the benefits derived from toe and heel mass concentrations and sole weighting. I have found that although minimizing the effects of mis-hits in the direction of the toe or heel of the club head is a major consideration in the design of the golf club heads, the effects of mis-hits in vertical directions relative to the center of gravity should not be overlooked.

As is the case with twisting movements of the club head resulting from mis-hits in the direction of the toe or heel, the club head will react to mis-hits in vertical directions by movements that may be described as tilting or tipping movements. When the impact point of the golf ball on the face of the club head is high on the face, i.e., above the sweet spot, that impact causes the club head to tilt about the center of gravity and such tilting will be in a direction which increases the loft angle of the club. This occurs due to the inertia of the mass concentration at the sole of the club head which causes the lower end of the club head to move forwardly under the ball in an arcuate path about the center of gravity. This movement is amplified by the relative lack of mass in the upper end of prior art golf clubs which results in a relatively small moment of inertia that provides very little resistance to tilting motion.

Similarly, when the impact point is low on the face of the golf club head, i.e., below the sweet spot, the lack of mass in the upper end of the club head provides a small moment of inertia and thus a very low resistance to tilting of the golf club head in a direction that reduces the loft angle of the club. In other words, the top end of the golf club head moves forwardly over the top of the ball in an arcuate path about the center of gravity.

To the best of my knowledge, no prior art golf clubs have been designed to provide mass concentration in the top part of iron type golf club heads with those concentrations being located and of sufficient magnitude to effectively minimize the hereinbefore described tilting problem.

A particular prior art golf club design is disclosed in U.S. Pat. No. 5,011,151 which issued to Anthony J. Antonious on Apr. 30, 1991. The club head disclosed in this patent had some of the mass, which is referred to as toe counterweight, located above a theoretical longitudinal axis of the club head. The longitudinal axis is defined as bisecting the face of the club head and is shown as extending between the heel and toe of the club head. The toe counterweight is a relatively large mass concentration which blends smoothly with the mass of the .sole so that the counterweight appears to be an upwardly sweeping extension of the sole. At least 25% and preferably 33% of the mass of the toe counterweight is disclosed as being located above the longitudinal axis to shift the center of gravity upwardly and toward the toe which maximizes the energy transfer when a golf ball is hit off-center toward the toe. Although the design of this prior art golf club appears to provide improved resistance to the club tilting problem, it is believed that less than the maximum benefit is achieved in that the toe counterweight does not extend all the way to the top of the toe but ends abruptly at a point below the top. This golf club design is further disclosed as having the top ridge at the upper end of the club of increased mass to provide a top counterweight. However, the cross-sectional configuration of the top ridge is of substantially rectangular conventional design and does not derive the maximum benefit from the mass located in that area.

Therefore, a need exists for a new and improved set of golf clubs which are configured to minimize the tilting motion of the club heads resulting from vertically miss-hit golf balls, and to otherwise provide a club head design with overall improvement of the club head balance.

SUMMARY OF THE INVENTION

In accordance with the present invention, iron type golf club heads are disclosed as having improved weight distribution for minimizing tilting movements of the heads when a golf ball is struck at a point that is either above or below the sweet spot of the club heads and for improving the overall balance of the clubs. These objectives are accomplished by removing some of the club head material from non-critical areas of conventionally designed golf club heads and relocating that material at specific areas at the upper portion of the heads to provide the improved design of the present invention.

More specifically, the ridges which extend longitudinally along the top of all conventional cavity back golf clubs are formed in the clubs of the present invention with increased mass along the length of the ridges. The cross-sectional configuration of the top ridge of each club is such that it located the mass as high as possible and set back from the face as much as is practical. In addition relatively large concentrations of mass are provided at both the heel and toe ends of the top ridges of the club heads. The mass concentration at the heel end of the top ridge extends rearwardly relative to the top ridge and is located above the heel end of the sole and blends smoothly with the mass at the heel end of the sole. The mass concentration at the toe end of the top ridge extends rearwardly relative to the top ridge and is located at the corner junction of the top ridge and the upper end of the toe.

As a direct result of the increased mass provided in the top ridges of the club heads of the present invention, the width of the top ridges is greater than in known club head designs and the width dimension of the top ridges is constant throughout most of the length thereof. Therefore, the back edge of the ridge of each club of the set of clubs of the present invention is linear and parallel to the front face of the golf club head and flares angularly and rearwardly at the toe end and to a lesser degree at the heel end as a result of the mass concentrations formed at those ends.

In order to locate the mass concentrations at the heel and toe ends of the top ridges as high as possible and set back as far as practical, both of those concentrations are in the form of cantilever protrusions. Each of these cantilever protrusions has a top surface which extends rearwardly from the top ridge of the club head and a back surface which depends angularly from the rearmost end of the top surfaces and inwardly toward the front of the club head. The cantilever configuration of the mass concentration formed at the toe end of the top ridge, provides the club heads with a unique characteristic feature. The width dimension at the central portion of the toe surface is considerably narrower than the width dimension at the top and bottom ends thereof. The front edge of the toe surface is, of course, straight in that it is the end edge of the front face of the golf club head. The rear edge of the toe surface is indented toward the front edge at its midpoint. In this way, there is a minimal amount of mass at the non-critical area in the middle of the toe surface and the head material that is available for the toe area is located at the top and bottom of the toe surface.

The addition of the increased upper heel and toe mass concentrations adds to the stability of the golf clubs in comparison to the prior art by adding to the club's ability to resist twisting resulting from laterally off-center toe or heel hits. Further, these upper mass concentrations in conjunction with the increased mass concentration provided in the top ridge will increase club stability by minimizing tilting movements in response to vertically off-center hits that are either too high or too low on the face of the club.

Accordingly, it is an object of the present invention to provide a new and improved set of iron type golf clubs having increased head mass concentrations at specific areas of the club heads to provide improved club head stability.

Another object of the present invention is to provide a new and improved set of iron type golf clubs wherein an increased amount of mass is provided in the upper areas of the golf club heads to enable the clubs to better resist twisting and tilting movements in reaction to miss-hit golf balls.

Another object of the present invention is to provide a new and improved set of golf clubs of the above described character wherein the increased mass is located along the top ridge of the club heads and at enlarged mass concentrations at the toe and heel end of the top ridge.

Still another object of the present invention is to provide a new and improved set of golf clubs of the above described type wherein the top ridge and the enlarged toe and heel mass concentrations are especially configured to position the mass as high as possible and set back from the face as much as is practical.

The foregoing and other objects of the present invention will be more fully understood from the following description when read in conjunction with the accompanying drawings.

BRIEF DESCRIPTION OF THE DRAWINGS

FIG. 19 is an exploded perspective view of a golf club iron-type head according to the present invention having a blade element and a perimeter weighting element.

FIG. 20 is a rear elevational view of the perimeter weighting element shown in FIG. 19.

FIGS. 21, 22, 23, 24 and 25 are sectional views taken along lines 21—21, 22—22, 23—23, 24—24 and 25—25, respectively, in FIG. 20.

FIG. 26 is an exploded perspective view of a prior art golf club iron-type head having a blade element and a perimeter weighting element.

FIG. 27 is a rear elevational view of the perimeter weighting element shown in FIG. 26.

FIGS. 28, 29, 30, 31 and 32 are sectional views taken along lines 28—28, 29—29, 30—30, 31—31 and 32—32, respectively, in FIG. 27.

DESCRIPTION OF THE PREFERRED EMBODIMENT

Figure 1:
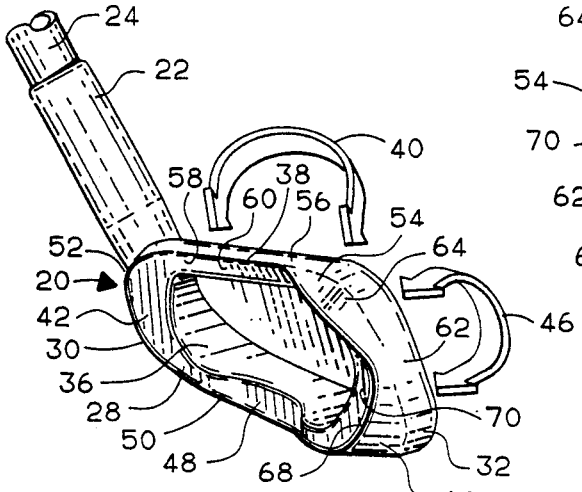
FIG. 1 is a perspective view of an iron golf club head with the illustrated head being a 3-iron of the golf club set of the present invention.

Referring more particularly to the drawings, FIGS. 1–6 show various views of golf club iron-type head such as a number 3-iron which :s configured in accordance with the present invention with the 3-iron being identified in its entirety by the reference numeral 20. The head 20 is provided with the usual parts and therefore has a hosel 22 which is connected in a conventional manner to a shaft 24. The hosel is integral with the head proper which has an impact face 26, a back surface 28, a heel portion 30, a toe portion 32, and a sole 34. The club head 20 is shown as being of the type often referred to as a cavity back club and is therefore formed with a cavity 36 in the back surface 28. The cavity 36 is defined on its lower side by the sole 34, on its opposite ends by the heel and toe portions 30 and 32 respectfully, and on its upper side by a top rail 38.

As is known, a cavity-back type golf club head design allows the club head material, which would otherwise be located in the cavity, to be relocated to strategic locations on such club heads to provide sole weighting, heel-toe weighting and in general, to improve the overall balance of the golf club head. By locating a mass concentration in the sole, the club head's center of gravity will be lowered and the theory is that this will make it easier for a golfer to get the center of gravity of the club head below the center of gravity of a golf ball and thereby produce a solidly hit golf ball at a proper launch angle.

Heel-toe weighting, or balance, is employed to provide golf clubs with the ability to resist twisting as a result of laterally off-center hitting of a golf ball. Twisting is the movement, in the direction indicated by the arrow 40 in FIG. 1, of the club head into an out-of-square position relative to the intended flight path of a golf ball. Such twisting results whenever a ball is struck on the toe or heel of the club head, i.e., laterally off-center. As is customary in the design of cavity-back golf clubs, the club head 20 of the present invention is provided with a first lower mass concentration 42 at the heel end of the sole 34 and a second lower mass concentration 44 at the toe end of the sole. These lower mass concentrations 42 and 44 provide an increase in the moment of inertia and thereby provide the club head 20 with the ability to resist twisting movements.

In addition to twisting, another form of unwanted head movement will occur as a result of vertically off-center hitting of a golf ball, and this type of movement will hereinafter be referred to as tilting, or tipping, of the golf club head. Whenever a golf ball is hit high or low on the face of the club head, a titling movement will occur and such tilting will be in the direction indicated by the arrow 46 in FIG. 1.

In accordance with the present inventions, the golf club head 20 is configured to enhance the resistance of the head to both the twisting and tilting movements discussed above. This is accomplished by redistributing the club head material to further strategic locations on the club head 20. In addition to redistribution of the club head material which would otherwise be in the cavity 36 as discussed above. A significant indentation is made at 48 in the center of the trailing edge 50 of the sole 34 and in the area of the back surface 28 which is proximate thereto. Such an indentation 48 is in accordance with my previous invention as set forth in the hereinbefore referenced U.S. Pat. No. 4,621,813.

The golf club head 20 is provided with an increased mass concentration in the top rail 38 and a mass concentration in the form of an upper protuberance 52 at the heel end of the top rail and another upper protuberance 54 at the toe end of the top rail. The upper heel protuberance 52 and the lower heel mass concentration 42 cooperate to increase the total mass at the heel 30 of the head 20 and the upper toe protuberance 54 and the lower toe mass concentration 44 cooperate to increase the total mass provided at the toe 32 of the club head 20. Such increased mass concentrations improve the heel-toe balance of the club head 20 and thus the club head's resistance to twisting movements as described above.

In addition, the increased mass in the top rail 38 and the upper heel and toe protuberances 52 and 54 cooperate with the lower heel and toe mass concentrations 42 and 44 to balance the club head 20 vertically and thereby increase the moment of inertia so that the club head 20 can better resist tilting movements of the type described above.

In the preferred embodiment, the top rail 38 and the upper heel and toe protuberances 52 and 54 are of special configuration to maximize the benefit derived from the head material that is relocated to provide the mass concentrations in those areas.

Figure 3:
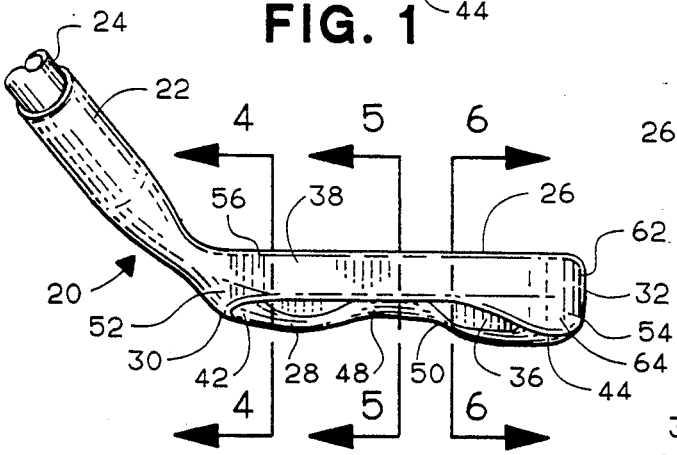
FIG. 3 is a top view of the club head of FIG. 1.
Figure 6:
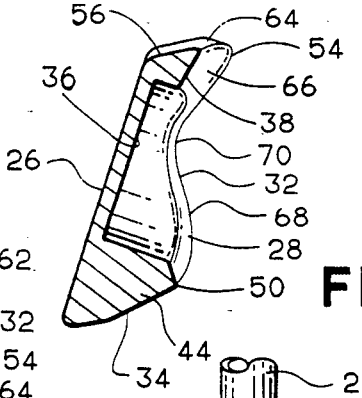
FIG. 6 is a sectional view taken along the line 6—6 of FIG. 3.
Figure 4:
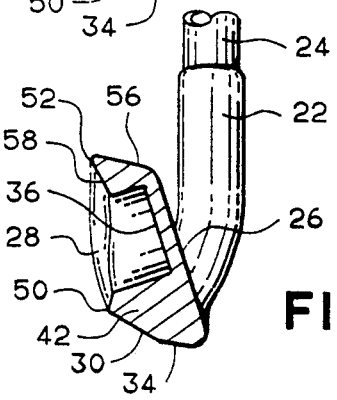
FIG. 4 is a sectional view taken along the line 4—4 of FIG. 3.
Figure 7:
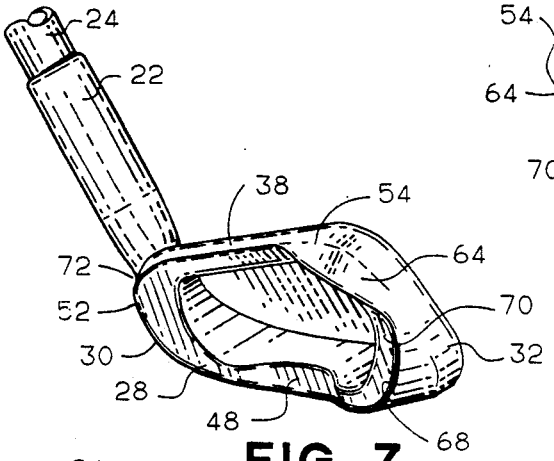
FIG. 7 is a perspective view of a 5-iron of the golf club set of the present invention.
Figure 8:
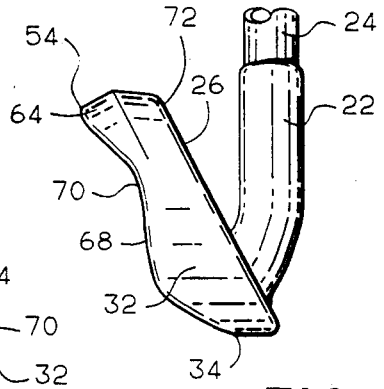
FIG. 8 is an elevational view of the toe end of the club head shown in FIG. 7.
Figure 9:
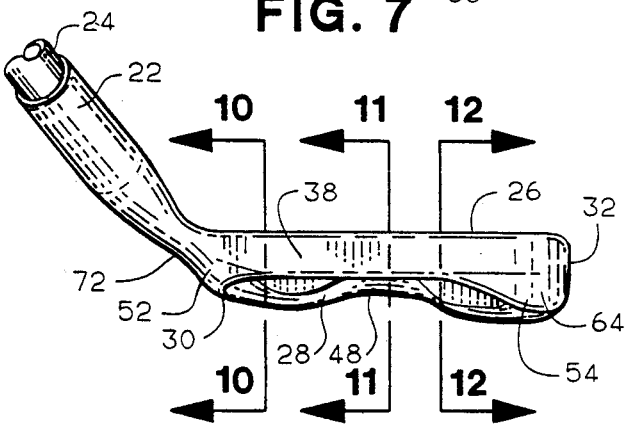
FIG. 9 is a top view of the club head of FIG. 7.
Figure 12:
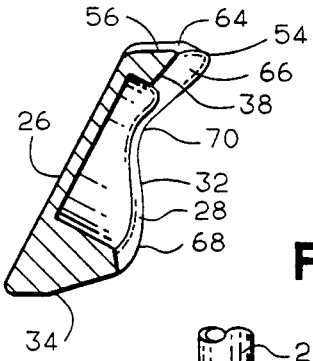
FIG. 12 is a sectional view taken along the line 12—12 of FIG. 9.
Figure 11:
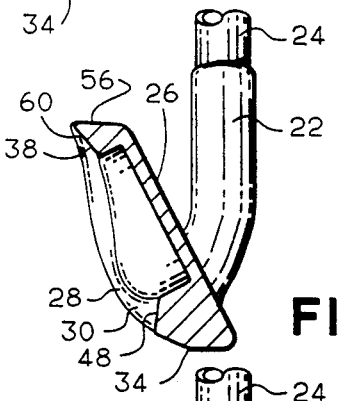
FIG. 11 is a sectional view taken along the line 11—11 of FIG. 9.
Figure 10:
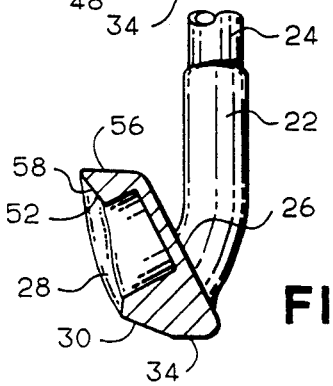
FIG. 10 is a sectional view taken along the line 10—10 of FIG. 9.
Figure 13:
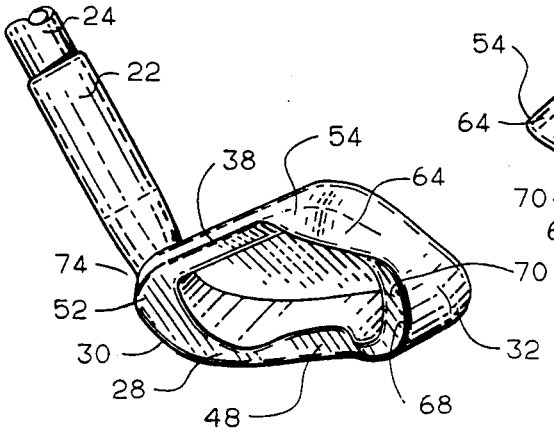
FIG. 13 is a perspective view of a 9-iron of the golf club set of the present invention.
Figure 14:
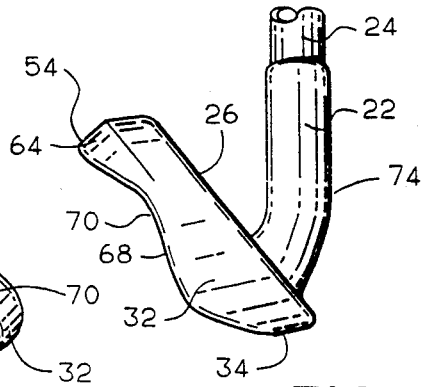
FIG. 14 is an elevational view of the toe end of the club head shown in FIG. 13.
Figure 15:
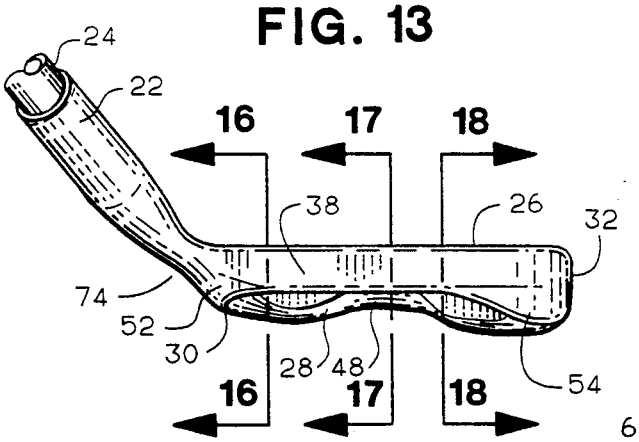
FIG. 15 is a top view of the club head of FIG. 13.
Figure 18:
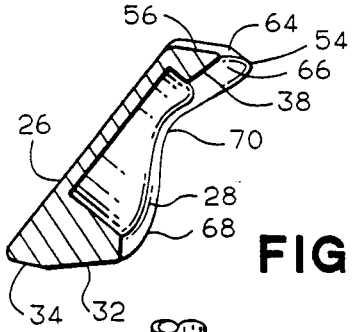
FIG. 18 is a sectional view taken along the line 18—18 of FIG. 15.
Figure 17:
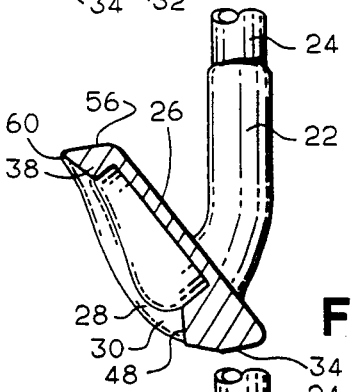
FIG. 17 is a sectional view taken along the line 17—17 of FIG. 15.
Figure 16:
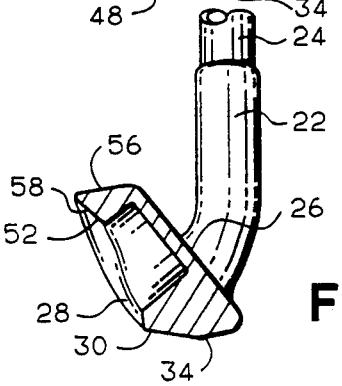
FIG. 16 is a sectional view taken along the line 16—16 of FIG. 15.

As seen best in FIGS. 3 and 4, the upper heel protuberance 52 is preferably in the form of a cantilever protrusion having a top surface 56 which forms an obtuse angle with respect to the face 26 of the club head 20. The top surface 56 is also the top surface of the rail 38 and the upper toe protuberance 54 and extends from the top end of the face 26 rearwardly of the club head 20. The upper heel protuberance 52 further includes a rear surface 58 that depends angularly from the rearmost edge of the top surface 56 and forms an acute included angle therewith so that the rear surface 58 slopes inwardly toward the front face 26 of the club head 20. These angularly related surfaces provide the upper heel protuberance 52 with the herein before discussed cantilever configuration which locates a maximum amount of the club head material as high and as far back from the club face as is possible and practical.

The moment of inertia of a body with respect to any axis is the sum of the products obtained by multiplying each elementary mass by the square of its distance from the axis. Therefore, the importance of locating the mass in the top ridge and in the upper heel and toe protuberances as high as possible on the golf club head 20 is readily apparent. Inertia also is effected by locating the material as far back from the club face as possible. Locating the head material in such a set back position relative to the face of the club head will result in the center of gravity of the club head being similarly located in a set back position relative to the face. The center of gravity acts like a mass concentration and the greater its distance from the face of the club head, the greater is the movement of inertia. This effects the club head's ability to resist twisting and tilting movements and improves the overall balance of the club head.

Figure 5:
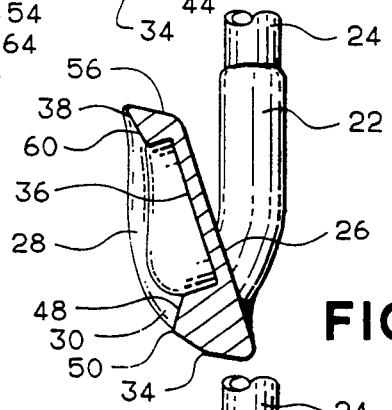
FIG. 5 is a sectional view taken along the line 5—5 of FIG. 3.
Figure 1A:
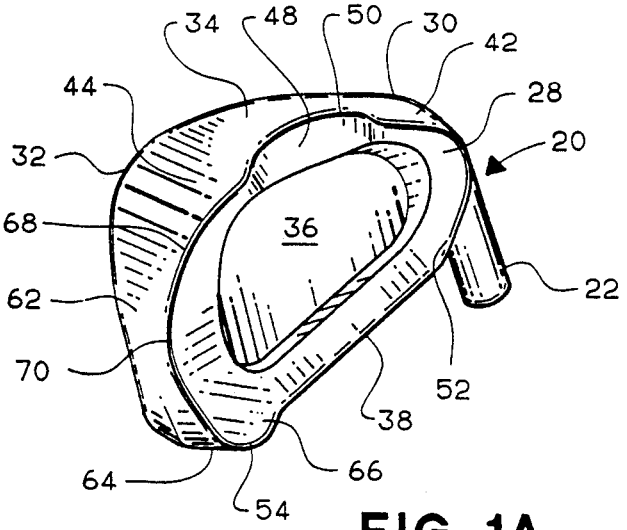
FIG. 1A is an inverted perspective view of the golf club head shown in FIG. 1.

FIGS. 3 and 5 best show the preferred special cantilever configuration of the top rail 38 as including the top surface 56 which extends rearwardly of the club's face 26 and forms an obtuse included angle therewith. A rear surface 60 depends angularly from the rearmost edge of the top surface 56 and forms an acute included angle therewith so that the rear surface 60 slopes inwardly toward the front face 26 of the club head 20. As was the case with the upper heel protuberance 52, the top rail 38 is preferably of a cantilever configuration to locate a maximum amount of the club head material as high and as far back from the club face as is possible and practical.

The upper toe protuberance 54 is located at the corner junction of the top ridge 38 and the upper end of the toe surface 62 of the club head, and is preferably of cantilever configuration as mentioned above. The top surface 64 of the upper toe protuberance 54 is of curvilinear shape formed jointly by the toe end of the top surface 56 and the upper end of the toe surface 62. The curvilinear shape of the top surface 64 along with the rearward extension of that surface provides the upper toe protuberance 54 with a hood-like configuration. The rear surface 66 of the upper toe protuberance extends angularly and inwardly from the rearmost end of the top surface 64 toward the face of the club head 20 and forms an acute included angle with respect to the top surface 64. The rear surface 66 follows the curve of the top surface and thus the upper toe protuberance 54 is of rearwardly extending cantilever shape with respect to both the toe end 32 of the club head as well as to the top rail 38.

Figure 2:
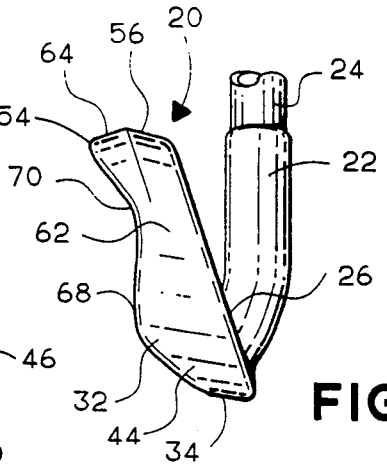
FIG. 2 is an elevational view of the toe end of the club head shown in FIG. 1.

As seen best in FIG. 2, the rearwardly extending hooded configuration of the upper toe protuberance 54 provides the club head with a unique characteristic feature. The back edge 68 of the toe surface 62 of the club head 20 is indented at 70 toward the face 26 of the club head 20. As is the case with the indentation 48 provided in the back edge of the sole 34, the area of the indention 70 is a non-critical area and the lack of mass concentrations in both of those indentations areas 48 and 70 will not detract from club head performance.

Reference is now made to FIGS. 7–12 wherein a number 5-iron golf club head 72 of a correlated golf club set is shown. As seen, the golf club head 72 is formed with the same increased mass concentrations as the hereinbefore described 3-iron golf club head 20. Therefore, in addition to the usual parts, the club head 72 has the upper heel protuberance 52, enlarged mass concentration in the top rail 38 and the upper toe protuberance 54. The 5-iron golf club head 72 is identical in all respects to the 3-iron golf club head 20 with the exception of the loft angle which is different as is well known in the art.

FIGS. 13–18 show still another golf club head 74 of the correlated set of golf clubs of the present invention. The head 74 is a 9-iron and is formed with the same increased mass concentrations as the above described 3 and 5 irons. Similarly the 9-iron golf club head 74 is identical to the 3 and 5 irons 20 and 72 with the exception of the loft angle.

Referring to FIGS. 19–25, a golf club iron-type head 76, which has the same features as the golf club heads 20, 72 and 74 shown in FIGS. 1–18, includes a blade element 78 and a perimeter weighting element 80. The blade element 78 has a length dimension, a front face 82, and a back face 84 spaced apart from and oriented substantially parallel to the front face 82. A generally oval-shaped central area 86 on the back face 84 is circumscribed by a back perimeter surface 88.

The perimeter weighting element 80 is substantially ring-shaped with a variable mass and extends from the back perimeter surface 88 of the blade element 78 in a generally rearward direction designated by arrow heads 90 shown in FIG. 19. The perimeter weighting element 80 includes an elongated top rail 92 divided by dashed lines 93 into a heel portion 94, a middle portion 96 and a toe portion 98. The top rial portions 94, 96 and 98 have depths A, B and C, respectively, measured in this generally rearward direction. As seen in FIG. 23, the depth C of the toe portion 98 exceeds the depths A and B or both the heel and middle portions 94, 96; and the depth A of the heel portion 94 exceeds the depth B of the middle portion 96. This relationship between the depths A, B and C of the top rail portions 94, 96 and 98 provides the top rail 92 with a unique configuration.

The top rail toe portion 98 extends between inner and outer ends **98*a*, 98*b* thereof, and the inner end 98*a* of the top rail toe portion 98 is located adjacent one end 96*a* of the top rail middle portion 96. The depth C of the top rail toe portion 98 increases from a minimum depth starting at the inner end 98***a* and reaches a maximum depth at the outer end 98*b*. This increase in the depth C of the top rail toe portion 98 is substantially linear from the inner end 98*a* to the outer end 98*b*. The depth B of the top rail middle portion 96 remains substantially constant between its ends 96*a*, 96*b*.

The perimeter weighting element 80 includes an upper section 100 and a lower section 102, and each of the sections 100, 102 has a relative mass. As shown in FIG. 24, the perimeter weighting element upper section 100 is divided by dashed lines 101 into a heel region 104, a central region 106 and a toe region 108; and, as shown in FIG. 25, the perimeter weighting element lower section 102 is divided by dashed lines 103 into a heel region 110, a central region 112 and a toe region 114. The heel, central and toe regions 104, 106, 108, 110, 112 and 114 have depths D, E, F, G, H and I, respectively, measured in the generally rearward direction designated by the arrow heads 90.

The central region 106 of the perimeter weighting element upper section 100 has a top surface 116 and a bottom surface 118, and the depth E of the upper section central region 106 varies as a function of elevation between the top and bottom surfaces 116, 118. As seen in FIG. 22, the depth E of the upper section central region 106 increases linearly from a minimum depth at the bottom surface 118 to a maximum depth at the top surface 116. The upper section central region 106 has a substantially planar rear surface 120 which is arranged so that it is not parallel to the front face 82 of the blade element 78 but lies in a plane 122 which intersects the front face 82 of the blade element 78.

The perimeter weighting element 80 extends rearward from the back perimeter surface 88 of the blade element 78 by a depth which varies as a function of position along the back perimeter surface 88. This varies the relative mass of the upper and lower sections 100, 102 of the perimeter weighting element 78 along the length dimension of the blade element 78. The upper section toe region 108 has a maximum depth F that exceeds a maximum depth D or E of the other upper section regions 104, 106. The lower section toe region 114 has a maximum depth I that exceeds a maximum depth G or H of the other lower section regions 110, 112, The perimeter weighting element 80 has inner and outer perimeter edges 124, 126 spaced from the back perimeter surface 88 of the blade element 78 by inner and outer perimeter depths J, K. the outer perimeter depth K of the perimeter weighting element upper section toe region 108 varies from a first depth to a second depth to a third depth as a function of clockwise movement in FIG. 20 through the toe region 108. The second depth is greater than either the first depth or the third depth. The inner perimeter depth J of the perimeter weighting element upper section toe region 108 varies from a fourth depth to a fifth depth to a sixth depth as a function of clockwise movement in FIG. 20 through the toe region 108. The fifth depth is greater than either the fourth depth or the sixth depth.

The outer perimeter depth K of the perimeter weighting element lower section toe region 114 varies from a first depth to a second depth to a third depth as a function of clockwise movement in FIG. 20 through the toe region 114. The second depth is greater than either the first depth or the third depth. The inner perimeter depth J of the perimeter weighting element lower section toe region 114 varies from a fourth depth to a fifth depth to a sixth depth as a function of clockwise movement in FIG. 20 through the toe region 114. The fifth depth is greater than either the fourth depth or the sixth depth.

The outer perimeter depth K of the perimeter weighting element lower section central region 112 has a minimum depth which is less than a minimum outer perimeter depth of either the perimeter weighting element lower section heel region 110 or the toe region 114. The inner perimeter depth J of the perimeter weighting element lower section central region 112 has a minimum depth which is less than a minimum inner perimeter depth of either the perimeter weighting element lower section heel region 110 or the toe region 114.

Although the golf club head 76 has been illustrated in FIG. 19 as being separated into the blade element 78 and the perimeter weighting element 80 to facilitate the foregoing description, it should be understood that the blade and perimeter weighting elements 78, 80 are integrally joined together in a golf club head according to the present invention. In fact, the blade and perimeter weighting elements 78, 80 are preferably integrally formed of steel by casting them as a single part.

The present invention is directed to golf club heads manufactured by casting processes and by forging processes. The present invention also relates to golf club heads made of steel and other suitable materials such as plastics.

Referring to FIGS. 26–32, a prior art golf club irontype head 128 such as disclosed in U.S. Pat. No. 4,621,813 is illustrated. The head 128 includes a blade element 130 and a perimeter weighting element 132. It will be understood that the blade element 130 is essentially identical to the blade element 78 of the golf club head 76 but the perimeter weighting element 132 is very different from the perimeter weighting element 80 of the golf club head 76. For example, the perimeter weighting element 130 has a top rail 134 with heel, middle and toe portions 136, 138 and 140 but the middle and toe portions 138, 140 are of equal depth L while the heel portion 136 has a depth M that exceeds the toe portion depth L as seen in FIG. 30.

The perimeter weighting element 132 includes an upper section 142 with heel, central and toe regions 144, 146 and 148, and a lower section 150 with heel, central and toe regions 152, 154 and 156. The upper section central region 146 has a depth N which does not vary but remains constant between its top and bottom surfaces 158, 160. A rear surface 162 of the upper section central region 146 is arranged parallel to the front face of the blade element 130 rather than in a plane which intersects the front face of the blade element 130. The upper section toe region 148 has a maximum depth O that is less than a maximum depth P of the upper section heel region 144.

Inner and outer perimeter edges 164, 166 of the perimeter weighting element 132 are spaced from the back perimeter surface of the blade element 130 by inner and outer perimeter depths Q, R. The outer perimeter depth R of the perimeter weighting element upper section toe region 148 does not vary from a first depth to a second depth to a third depth with the second depth begin greater than either the first or third depth. In the perimeter weighting element lower section 150, the inner and outer perimeter depths Q and R each have a maximum depth which is greater in the central region 154 than in the heel region 152.

While the principles of the invention have been made clear in an illustrated embodiment, there will be immediately obvious to those skilled in the art many modifications of structure, arrangement and so forth which are particularly adapted for specific purposes without departing from those principles. The appended claims are therefore intended to cover and embrace any such modifications within the limits only of the true spirit and scope of the invention.

What I claim is:

1. A golf club iron-type head comprising:

a blade element having a front face, a back face spaced apart from in a generally rearward direction and oriented substantially parallel to the front face, and a central area on the back face circumscribed by a back perimeter surface; and a substantially ring-shaped, variable mass perimeter weighting element extending from the back perimeter surface of the blade element in the generally rearward direction and including a sole and a top rail located above the sole in a generally vertical direction, the top rail having a middle portion and a toe portion, each of the top rail portions having a depth measured in the generally rearward direction, and the toe portion depth exceeding the middle portion depth.

2. The golf club iron-type head of claim 1, wherein the top rail toe portion has an inner end located adjacent one end of the top rail middle portion and an outer end, and wherein the depth of the top rail toe portion increases from a minimum depth starting at the inner end.

3. The golf club iron-type head of claim 2, wherein the depth of the top rail toe portion reaches a maximum depth at the outer end.

4. The golf club iron-type head of claim 3, wherein the depth of the top rail toe portion increases from the inner end to the outer end.

5. The golf club iron-type head of claim 4, wherein the depth of top rail toe portion increases substantially linearly from the inner end to the outer end.

6. The golf club iron-type head of claim 1, wherein the depth of the top rail middle portion is substantially constant between its ends.

7. The golf club iron-type head of claim 1, wherein the top rail also has a heel portion with a depth measured in the generally rearward direction, and wherein the top rail heel portion depth exceeds the top rail middle portion depth.

8. The golf club iron-type head of claim 7, wherein the top rail toe portion depth also exceeds the top rail heel portion depth.

9. A golf club iron-type head comprising:

a blade element having a length dimension, a front face, a back face spaced apart from in a generally rearward direction and oriented substantially parallel to the front face, and a central area on the back face circumscribed by a back perimeter surface;

a substantially ring-shaped, variable mass perimeter weighting element extending from the back perimeter surface of the blade element in the generally rearward direction, the perimeter weighting element including an upper section and a lower section, the upper and lower sections of the perimeter weighting element each having a heel region, a central region and a toe region, each of these heel, central and toe regions having a depth measured in the generally rearward direction; and the central region of the perimeter weighting element upper section having a top surface elevated above a bottom surface, the depth of the central region of the perimeter weighting element upper section increasing in a generally upward direction from the bottom surface to the top surface thereof with the depth of the central region of the perimeter weighting element upper section reaching a maximum depth at the top surface.

10. The golf club iron-type head of claim 9, wherein the depth of the central region of the perimeter weighting element upper section reaches a minimum depth at the bottom surface.

11. The golf club iron-type head of claim 10, wherein the depth of the central region of the perimeter weighting element upper section increases linearly from the bottom surface to the top surface.

12. The golf club iron-type head of claim 9, wherein the central region of the perimeter weighting element upper section has a substantially planar rear surface.

13. The golf club iron-type head of claim 12, wherein the planar rear surface of the central region of the perimeter weighting element upper section is not parallel to the front face of the blade element.

14. The golf club iron-type head of claim 13, wherein the planar rear surface of the central region of the perimeter weighting element upper section lies in a plane which intersects the front face of the blade element.

15. The golf club iron-type head of claim 9, wherein the upper and lower sections of the perimeter weighting element each have a predetermined relative mass, wherein the perimeter weighting element extends in the generally rearward direction from the back perimeter surface of the blade element by a depth which varies as a function of position along the back perimeter surface in order to vary the relative mass of the upper and lower sections along the length dimension of the blade element, and wherein the perimeter weighting element upper section toe region has a maximum depth that exceeds a maximum depth of any other region of the perimeter weighting element upper section.

16. The golf club iron-type head of claim 15, wherein the perimeter weighting element lower section toe region has a maximum depth that exceeds a maximum depth of any other region of the perimeter weighting element lower section.

17. A golf club iron-type head comprising:

a blade element having a front face, a back face spaced apart from in a generally rearward direction and oriented substantially parallel to the front face, and said back face including a central area and a back perimeter surface circumscribing the central area; 'a substantially ring-shaped, variable mass perimeter weighting element extending from the back perimeter surface on the back face of the blade element in the generally rearward direction, the perimeter weighting element including an upper section and a lower section, the upper and lower sections of the perimeter weighting element each having a heel region, a central region and a toe region, each of these heel, central and toe regions having a depth measured in the generally rearward direction;

the perimeter weighting element having an inner perimeter edge and an outer perimeter edge, the inner perimeter edge being spaced from the back perimeter surface on the back face of the blade element by an inner perimeter depth, and the outer perimeter edge being spaced from the back perimeter surface on the back face of the blade element by an outer perimeter depth; and the outer perimeter depth of the perimeter weighting element upper section toe region varying from a first depth to a second depth to a third depth as a function of clockwise movement in a direction about the ring-shaped variable mass perimeter weighting element through that toe region, the second depth being greater than either the first depth or the third depth.

18. The golf club iron-type head of claim 17, wherein the inner perimeter depth of the perimeter weighting element upper section toe region varies from a fourth depth to a fifth depth to a sixth depth as a function of clockwise movement in a direction about the ring-shaped variable mass perimeter weighting element through that toe region, and wherein the fifth depth is greater than either the fourth depth or the sixth depth.

19. The golf club iron-type head of claim 18, wherein the outer perimeter depth of the perimeter weighting element lower section toe region varies from a first depth to a second depth to a third depth as a function of clockwise movement in a direction about the ring-shaped variable mass perimeter weighting element through that toe region, and wherein the second depth is greater than either the first depth or the third depth.

20. The golf club iron-type head of claim 19, wherein the inner perimeter depth of the perimeter weighting element lower section toe region varies from a fourth depth to a fifth depth to a sixth depth as a function of clockwise movement in a direction about the ring-shaped variable mass perimeter weighting element through that toe region, and wherein the fifth depth is greater than either the fourth depth or the sixth depth.

21. The golf club iron-type head of claim 17, wherein the outer perimeter depth of the perimeter weighting element lower section toe region aries from a first depth to a second depth to a third depth as a function of clockwise movement in a direction about the ring-shaped variable mass perimeter weighting element through that toe region, and wherein the second depth is greater than either the first depth or the third depth.

22. The golf club iron-type head of claim 21, wherein the inner perimeter depth of the perimeter weighting element lower section toe region varies from a fourth depth to a fifth depth to a sixth depth as a function of clockwise movement in a direction about the ring-shaped variable mass perimeter weighting element through that toe region, and wherein the fifth depth is greater than either the fourth depth or the sixth depth.

23. The golf club iron-type head of claim 17, wherein the outer perimeter depth of the perimeter weighting element lower section central region has a minimum depth which is less than a minimum outer perimeter depth of either the perimeter weighting element lower section heel region or toe region.

24. The golf club iron-type head of claim 23, wherein the inner perimeter depth of the perimeter weighting element lower section central region has a minimum depth which is less than a minimum inner perimeter depth of either the perimeter weighting element lower section heel region or toe region.

25. The golf club iron-type head of claim 17, wherein the inner perimeter depth of the perimeter weighting element lower section central region has a minimum depth which is less than a minimum inner perimeter depth of either the perimeter weighting element lower section heel region or toe region.

* * * * *